US010197057B2

(12) United States Patent
Briere

(10) Patent No.: US 10,197,057 B2
(45) Date of Patent: Feb. 5, 2019

(54) GEAR PUMP FOR COMPRESSIBLE LIQUIDS OR FLUIDS

(71) Applicant: GEORGES BRIERE S.A., Argenteuil (FR)

(72) Inventor: Olivier Briere, Argenteuil (FR)

(73) Assignee: GEORGES BRIERE S.A., Argenteuil (FR)

( * ) Notice: Subject to any disclaimer, the term of this patent is extended or adjusted under 35 U.S.C. 154(b) by 0 days.

(21) Appl. No.: 15/554,096

(22) PCT Filed: Feb. 17, 2016

(86) PCT No.: PCT/FR2016/050359
§ 371 (c)(1),
(2) Date: Aug. 28, 2017

(87) PCT Pub. No.: WO2016/142597
PCT Pub. Date: Sep. 15, 2016

(65) Prior Publication Data

US 2018/0045198 A1 Feb. 15, 2018

(30) Foreign Application Priority Data

Mar. 11, 2015 (FR) ..... 15 52016

(51) Int. Cl.
*F01C 11/00* (2006.01)
*F03C 2/00* (2006.01)
(Continued)

(52) U.S. Cl.
CPC ..... *F04C 15/0061* (2013.01); *F04C 2/084* (2013.01); *F04C 2/18* (2013.01);
(Continued)

(58) Field of Classification Search
CPC .... F04C 2/08; F04C 2/18; F04C 2/084; F04C 2/086; F04C 2/088; F04C 2/14;
(Continued)

(56) References Cited

U.S. PATENT DOCUMENTS 3,272,140 A * 9/1966 Curry ..... F04C 11/001 418/200
3,602,617 A * 8/1971 Takahashi ..... F04C 11/001 418/199
(Continued)

FOREIGN PATENT DOCUMENTS

| | | |
|---|---|---|
| CN | 102 767 515 A | 11/2012 |
| DE | 855 945 C | 11/1952 |
| FR | 2 399 559 A1 | 3/1979 |

OTHER PUBLICATIONS

International Search Report, dated May 2, 2016, from corresponding PCT/FR2016/050359 application.

*Primary Examiner* — Theresa Trieu
(74) *Attorney, Agent, or Firm* — Young & Thompson

(57) ABSTRACT

Disclosed is a gear pump including a pumping chamber in which a first shaft and a second shaft are rotated about their respective axes, each of the first and second shafts supporting at least one hydraulic-pumping element that hydraulically pumps a fluid in the pumping chamber, the at least one hydraulic-pumping element of each of the first and second shafts being positioned in the pumping chamber and each having at least one first radial projection. In the pumping chamber, each of the first and second shafts further supports at least one mechanical drive pinion that rotates each of the first and second shafts, each mechanical drive pinion having second radial projections. The at least one mechanical drive pinion is separate from the at least one hydraulic-pumping
(Continued)

element, and the number of the at least one first radial projection and of the second radial projections is different.

19 Claims, 8 Drawing Sheets

(51) Int. Cl.

| | |
|---|---|
| ***F03C 4/00*** | (2006.01) |
| ***F04C 2/00*** | (2006.01) |
| ***F04C 15/00*** | (2006.01) |
| ***F04C 11/00*** | (2006.01) |
| ***F04C 2/18*** | (2006.01) |
| ***F04C 2/08*** | (2006.01) |
| *F04C 23/00* | (2006.01) |

(52) U.S. Cl.
CPC ..... *F04C 11/001* (2013.01); *F04C 11/005* (2013.01); *F04C 23/001* (2013.01); *F04C 2240/20* (2013.01); *F04C 2240/30* (2013.01)

(58) Field of Classification Search
CPC .... F04C 11/001; F04C 11/005; F04C 23/001; F04C 2240/20; F04C 2240/30; F01C 1/18; F01C 1/20
USPC ..... 418/9, 189–190, 198–200, 206.1–206.9
See application file for complete search history.

(56) References Cited

U.S. PATENT DOCUMENTS

| | | | | |
|---|---|---|---|---|
| 5,092,751 | A * | 3/1992 | Viktora | F04C 11/001 418/200 |
| 5,755,566 | A * | 5/1998 | Marsillo | F04C 11/001 418/200 |
| 2014/0200109 | A1* | 7/2014 | Stocco | F04C 2/084 475/331 |
| 2014/0271313 | A1 | 9/2014 | Flavelle | |

* cited by examiner

GEAR PUMP FOR COMPRESSIBLE LIQUIDS OR FLUIDS

BACKGROUND OF THE INVENTION

Field of the Invention

The invention relates to gear pumps for compressible liquids or fluids.

It relates more particularly to a new design for a pump structure, intended to achieve better pumping performance.

An advantageous application of the invention can also be found in its utilization in volumetric pumps, even though it can be applied to other types of pumps.

Description of the Related Art

There are several kinds of volumetric pumps, including those known as "synchronous gear" pumps and "self-driven" pumps.

Synchronous gear pumps comprise two pinions each equipped with peripheral teeth. In such pumps, the teeth of the two pinions do not touch one another. However, the teeth of the two pinions can be meshed with one another. Each of the two pinions is rotationally driven by a shaft. In other words, such pumps include two shafts for driving the pinions in rotation. Provision is then made for a gearbox in a sealed portion of the pump for synchronizing the rotation of the shafts. The teeth of the pinions for synchronous gear pumps are shaped such that rotation of the two pinions is allowed. The face of the teeth that is oriented towards the direction of rotation of the pinion is called "front face". The other face of the teeth is called "rear face".

Self-driven pinion pumps also include two pinions each equipped with evenly distributed peripheral teeth. In such pumps, one of the pinions (first pinion) is mounted on a rotationally-driven shaft. This first pinion drives the second pinion in rotation, by meshed contact of the teeth with one another. To this end, the teeth are thus shaped such that rotation of the two pinions is allowed. The front face of the teeth is then called "active face". This is the face of the tooth of a first pinion that comes into contact with the face of a tooth of the other pinion, and that allows the other pinion to be rotationally driven. The other face of the tooth, i.e. the rear face, is also called "inactive face".

The invention relates to self-driven pinion pumps.

Generally, pinions equipped with peripheral teeth in the form of lobes are found in synchronous gear pumps.

By "lobes" is meant teeth of a larger size, the end of which may have a curved shape. The radial projections of the gear wheels are called "teeth" when they are smaller, not so large as the lobes, with one end having a more pointed shape, or having sharp edges.

There are self-driven pumps that have pinions with lobes: one example of such a pump is described in particular in application FR 2 399 559.

For decades, in order to improve pump performance, persons skilled in the art have sought to modify the profile of the lobes or the teeth of the pinions. Persons skilled in the art have also sought to adjust the number of teeth or lobes of the gears. Furthermore, it has been demonstrated that the greater the number of projections (teeth or lobes) the pinion has, the better the mechanical drive. However, the greater the number of projections (teeth or lobes) the pinion has, the poorer the performance of the hydraulic drive.

Persons skilled in the art have often favoured the mechanical drive by utilizing gears with toothed pinions in self-driven pinion pumps.

Moreover, hybrid technical solutions, utilizing pinions with lobes and with teeth, have also been developed by persons skilled in the art in order to improve the hydraulic drive performance.

For example, document US 2014/0271313 presents a volumetric pump in which a three-lobed pinion and a three-toothed pinion intermesh with one another. As a result of the differences of shape and size of the intermeshed lobes and teeth, it is necessary for each shaft to have several stages of lobed and/or toothed pinions, angularly offset with respect to one another such that, when a first set of lobed and toothed pinions is no longer driven, a second set of lobed and toothed pinions takes over.

Such an embodiment does not give satisfactory pumping results, on account in particular of the necessary interchange between the different stages of lobed and toothed pinion sets, and on account of the leakage of liquid (or fluid) from one stage to another during pumping, unless radial fins are utilized between the pumping stages, preventing the fluid from leaking.

BRIEF SUMMARY OF THE INVENTION

A purpose of the invention is to offer a solution with improved performance over those described in documents FR 2 399 559 and US 2014/0271313.

To this end, it relates to a gear pump, including a pumping chamber in which a first shaft and a second shaft are rotationally driven about their respective axis, each of the first and second shafts bearing at least one hydraulic pumping element ensuring hydraulic pumping of a fluid in the pumping chamber, said at least one hydraulic pumping element of each of said first and second shafts being positioned in said pumping chamber and each having at least one first radial projection.

The pump according to the invention is notable in that, in the pumping chamber, each of said first and second shafts also bears at least one pinion for mechanically driving in rotation each of said first and second shafts, each mechanical drive pinion having second radial projections. In addition, on each of said first and second shafts, said at least one mechanical drive pinion is distinct from said at least one hydraulic pumping element. Moreover, said at least one first radial projection and said second radial projections differ in number. Finally, the assembly formed by said at least one mechanical drive pinion and said at least one hydraulic pumping element of said first and second shafts constitutes the gearing of the pump.

By "distinct" is meant the fact that the mechanical drive pinion and the hydraulic pumping element borne by one and the same shaft are made of two parts from different pieces (*New Shorter Oxford,* 1973: Distinct means "distinguished as not being the same; separate, individual". Distinct is to be understood in the sense of "different, independent, separate") By "distinct" is therefore meant that the hydraulic pumping element and the mechanical drive pinion can correspond to two different portions of an element produced in a single piece. By "distinct" can also be understood that the hydraulic pumping element and the mechanical drive pinion are made in two pieces that are produced independently of one another and that are placed on one shaft.

Made in this way, the pump according to the invention distinguishes, in the pumping chamber, the elements ensuring the hydraulic drive of the fluid from those ensuring the mechanical drive of the shafts in rotation. In other words, according to the invention, the elements ensuring the hydraulic drive of the fluid are no longer also used in order to ensure the mechanical drive of the shafts in rotation about their axis. Thus provision can be made for hydraulic drive elements that have very different profiles, depending on the characteristics of the pumped fluid, and even profiles that would not be considered today by a person skilled in the art because these profiles would not allow the shafts to be mechanically self-driven.

In addition, as the pinions dedicated to the mechanical drive of the shafts no longer serve to pump the fluid in the chamber, they may have the shape of a disk, as they no longer need to extend substantially over the entire length of the shaft in the pumping chamber. Such pinions can thus be produced in stronger materials, ensuring the pump has a better service life and the shafts being better rotationally self-driven about the axis thereof.

Finally, as will be noted hereinafter, by separating the mechanical drive pinion and the hydraulic pumping elements, it is possible to choose to combine different hydraulic pumping element profiles and different mechanical drive pinion profiles, and even to some extent to orientate the profiles with respect to one another in order to optimize the pump performance depending on the pumping fluid.

The invention can also comprise the following characteristics, alone or in combination:

- said at least one hydraulic pumping element of each shaft is made from at least one lobed gear wheel, the lobes constituting first projections for the hydraulic pumping element,
- said at least one first projection has a first radial height, the second projections have a second radial height, and said first radial height is greater than said second radial height,
- each of the first and second shafts bears a mechanical drive pinion positioned between two hydraulic pumping elements,
- each of the first and second shafts bears a hydraulic pumping element positioned between two mechanical drive pinions,
- each of the first and second shafts bears a hydraulic pumping element and a mechanical drive pinion,
- on each of the first and second shafts, said at least one mechanical drive pinion is fixed to said at least one hydraulic pumping element,
- the pump comprises means for the angular adjustment of the position of said at least one hydraulic pumping element with respect to said at least one mechanical drive pinion about the axis of said first and second shafts,
- for each of said first and second shafts, said at least one hydraulic pumping element and said at least one mechanical drive pinion are made from different materials,
- said at least one hydraulic pumping element and said at least one mechanical drive pinion of each shaft are made in a single piece.

BRIEF DESCRIPTION OF THE DRAWINGS

So that it can be carried out, the invention is disclosed in a manner sufficiently clear and complete in the following description, which is in addition accompanied by drawings in which.

DETAILED DESCRIPTION OF THE PREFERRED EMBODIMENTS

In the following description, the terms "lesser", "greater", "high", "low" etc.

are used with reference to the drawings for ease of understanding. They are not to be understood as limitations to the scope of the invention.

Figure 1:
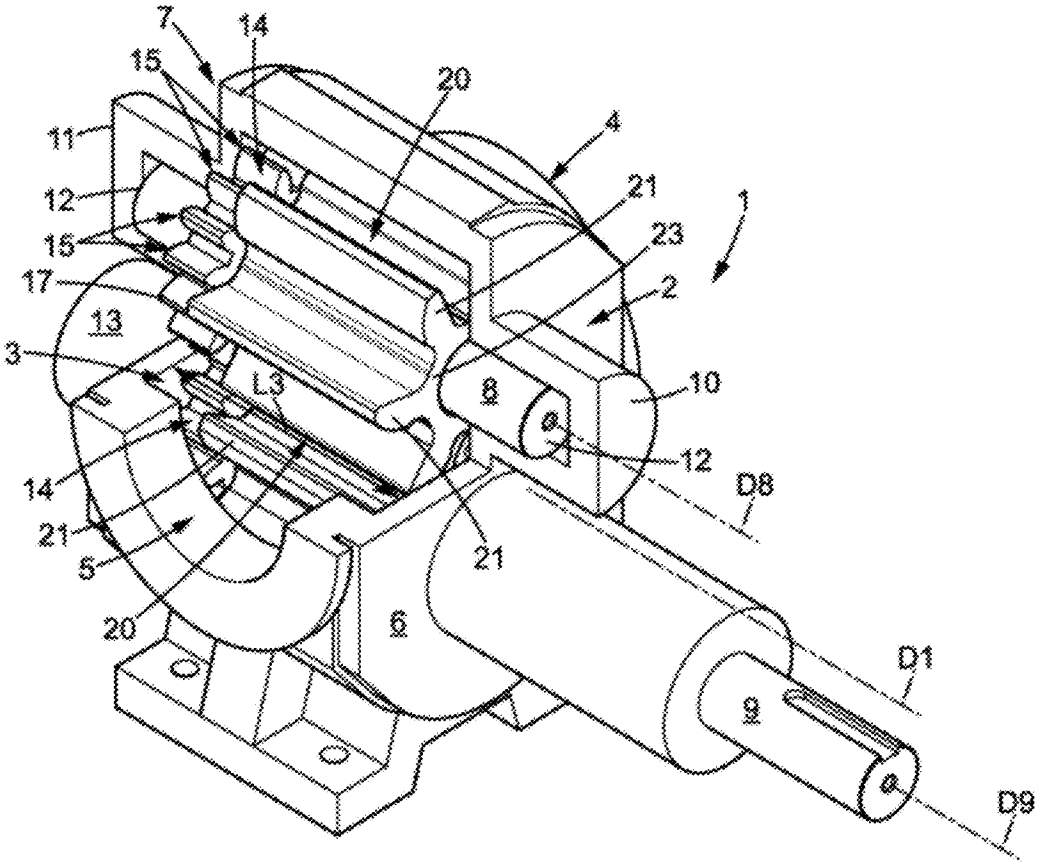
FIG. 1 is a perspective view of a gear pump according to the invention, showing a pumping chamber that is partially open in order to show the elements that it encloses.

FIG. 1 shows a volumetric gear pump 1 according to the invention, including a pumping chamber 2.

The pumping chamber 2 has an internal cavity 3 which is substantially elliptical in cross section.

Transversally, the chamber has an inlet opening 4 for a fluid, through which a pumped fluid is introduced into the cavity 3 of the chamber 2, and an outlet opening 5 through which the pumped fluid is discharged.

Longitudinally, the chamber 2 also has two end walls 6 and 7, closing the cavity 3.

Two shafts 8 and 9, having the same diameter, pass through the cavity 3 of the chamber 2, and the respective axes thereof, D8 and D9, are oriented in a direction parallel to a longitudinal axis D1.

The volumetric pump 1 is a pump with self-driven pinions.

Thus, one of the shafts (shaft 9 in the present case) extends from the cavity of the chamber 1 for connection to a rotational-drive system (not shown).

The other shaft (shaft 8 in the present case) is mounted idle in the cavity of the chamber.

To this end, the ends 12 of the shaft 8 are inserted into cylindrical housings 10 and 11 which are integral with the end walls 6 and 7, respectively, the cylindrical housings 10 and 11 being open towards the cavity 3.

The end of the shaft 9 which is not connected to a rotational-drive motor is also inserted into a cylindrical housing 13 integral with one 7 of the end walls of the chamber 2.

The ends of the shafts 8 and 9 positioned in the cylindrical housings 10, 11 and 13 are free to rotate about their axis in the cylindrical housings 10, 11 and 13.

So that the rotation of the shaft 9 about its axis D9 drives the rotation of the shaft 8 about its axis D8, each of the shafts 8 and 9 bears a mechanical drive pinion 14 (see in particular FIG. 2), the two mechanical drive pinions 14 having projections 15 evenly distributed around a disk 16, the projections of the two mechanical drive pinions 14 being meshed together when the two shafts are positioned in the pump. The two pinions 14 thus constitute a gearing for the pump 1.

The projections 15 of the mechanical drive pinions 14 are teeth within the meaning of the present description, as these projections are of small size (compared to the size of other radial projections that will be presented hereinafter) and each have a substantially pointed free end 17.

Figure 5:
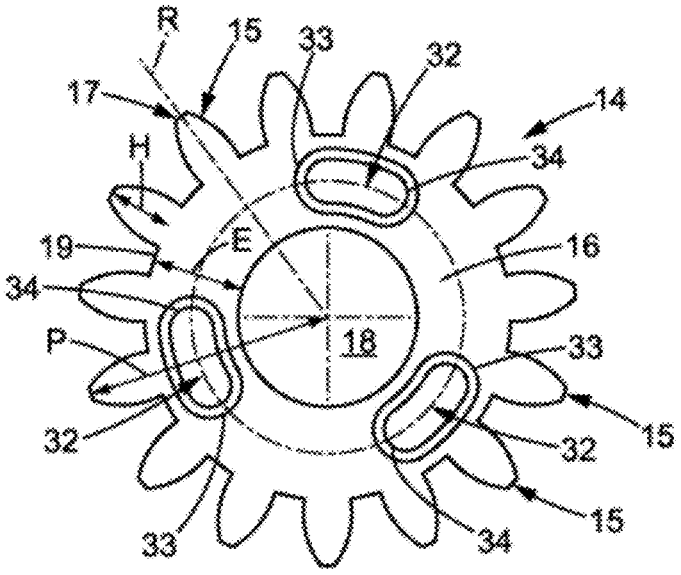
FIG. 5 is a front view of a mechanical drive pinion of the gear pump shown in FIGS. 1 to 4.

Furthermore the projections 15 (or teeth 15) all have axial symmetry on each side of the radii R of the disk 16 along each of which they extend (see FIG. 5 in particular). This symmetry allows the mechanical drive pinion 14 to be rotationally driven in one direction or the other about its axis. As a result, the shaft 9 can be rotationally driven about its axis D9 in one direction or the other. The direction of rotation of the shaft 9 is determined depending on whether it is desired to introduce the fluid to be pumped into an opening 4 or into another 5 in the pumping chamber 2.

All the mechanical drive pinions 14 shown in the embodiments each include fifteen projections 15 (or teeth 15), and the projections 15 have a height H.

The disk 16 of the mechanical drive pinions 14 has a central through hole 18 the diameter of which corresponds substantially to that of the shaft 8 (or of the shaft 9), and is preferably slightly greater than that of the shaft 8 (or of the shaft 9), so that the pinion can be slipped onto the shaft 8 (or onto the shaft 9).

The radial thickness E of the disk 16, measured between the hole 18 and the outer wall 19 of the disk 16 between two teeth 15 is greater than the height H of the teeth 15 of the mechanical drive pinions 14.

The radius P of each of the mechanical drive pinions 14 corresponds to the sum of the radius of the hole 18, the thickness E of the disk 16 and the height H of a tooth 15.

According to the invention, each shaft 8 et 9 also bears a hydraulic pumping element, placed with a mechanical drive pinion 14 in the pumping chamber 2.

FIGS. 1 to 4 show a first example of hydraulic pumping elements 20.

Figure 2:
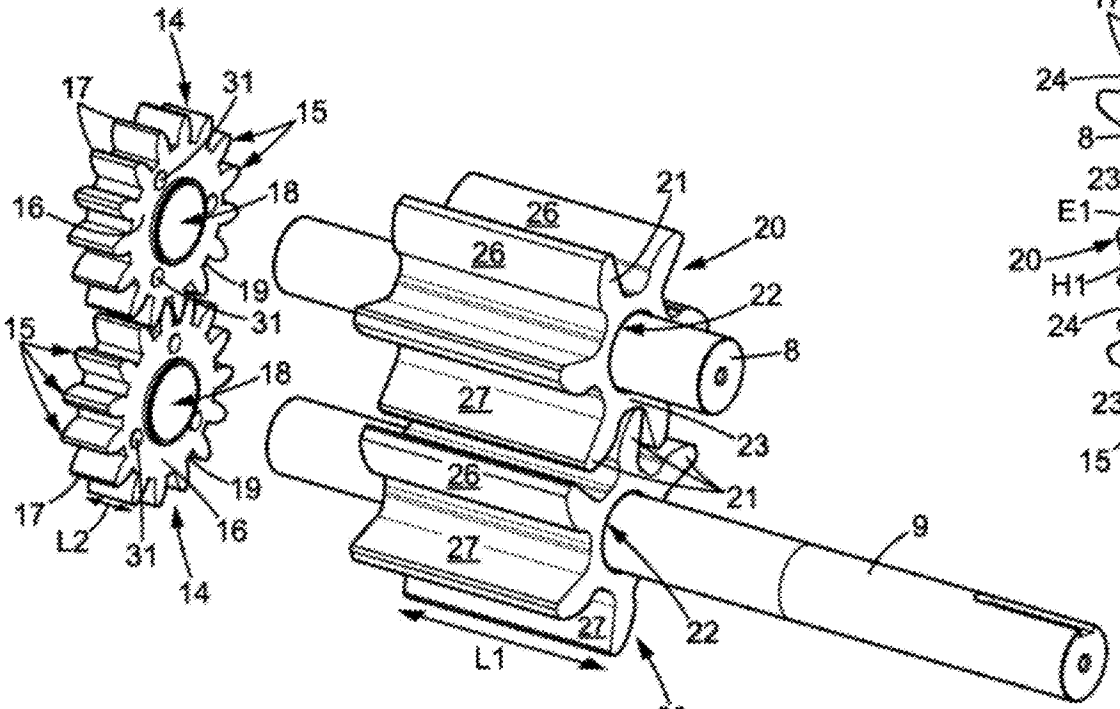
FIG. 2 is an exploded perspective view of various internal elements in the pumping chamber of the pump shown in FIG. 1.

Gear wheels 20 with lobes 21, which can be seen in particular in FIG. 2, constitute the hydraulic pumping elements.

Each of the gear wheels 20 with lobes 21 extends in an axial direction over a length L1, which is greater than the length L2 over which the mechanical drive pinion 14 extends.

Figure 4:
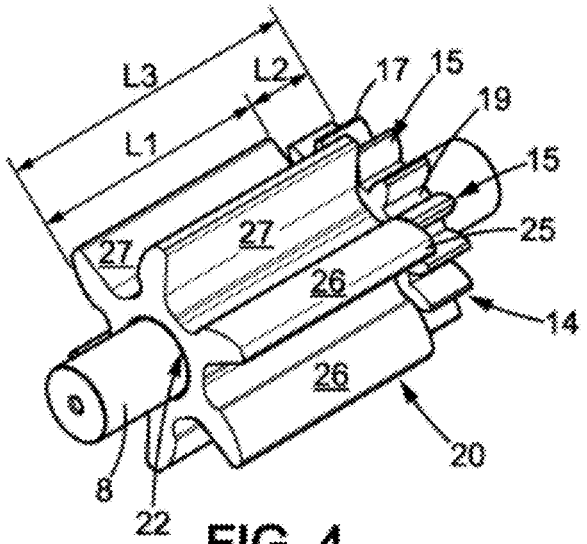
FIG. 4 is a perspective view of a shaft on which a hydraulic pumping element and a drive pinion are mounted.

The sum of the lengths L1 and L2 corresponds substantially to the length L3 of the cavity 3 of the chamber, measured substantially between the two inner end walls 6 and 7 of the pumping chamber 2 (see FIGS. 1 and 4 in particular).

Each of the gear wheels 20 with lobes 21 has a central axial through hole 22 with a cylindrical shape, the diameter of which corresponds substantially to that of the shaft 8 (or of the shaft 9), and is preferably slightly greater than that of the shaft 8 (or of the shaft 9), so that the pinion can be slipped onto the shaft 8 (or onto the shaft 9).

Between the central opening 22 and the lobes 21, each of the gear wheels 20 has a central portion 23, the radial thickness E1 of which, measured between the opening 22 and the outer wall 24 of the gear wheel 20 between two lobes 21, is less than the height H1 of the lobes 21 of the gear wheels 20.

The radius P1 of each of the gear wheels 20 with lobes 21 corresponds to the sum of the radius of the opening 22, the thickness E1 of the central portion 23 and the height H1 of a lobe 21.

It will be noted that the radius P1 of the lobed gear wheels 20 is greater than the radius P of the mechanical drive pinions 14.

It will also be noted that the radial thickness E1 of the lobed gear wheels 20 is smaller than the radial thickness E of the mechanical drive pinions 14.

Finally, it will be noted that the height H1 of the lobes is greater than the height of the projections 15 (or teeth 15) of the mechanical drive pinions 14.

In the embodiment shown in FIGS. 1 to 4, the mechanical drive pinions 14 and the lobed gear wheels 20 can be made from different materials. The advantage of making the element 20 dedicated to the hydraulic pumping and the pinion 14 dedicated to the mechanical drive in two parts is that it is possible to make the pinion 14 from stronger materials (or those more suitable for the characteristics of the fluid to be pumped) than conventional drive pinions (which are also dedicated to hydraulic pumping, unlike the invention).

Thus, thanks to the invention, it is possible to choose the material from which the mechanical drive pinions 14 and the lobed gear wheels 20 are made, which was not obvious within the context of producing conventional self-driven pump pinions.

In addition, it will be noted that the lobed gear wheels shown in FIGS. 1 to 4 each have six lobes 21, while the mechanical drive pinions 14 each have fifteen teeth 15. Thus, by separating the elements dedicated to hydraulic pumping from those dedicated to mechanical drive, provision can be made for a different number of projections between the gear wheel 20 and the pinion 14. In fact, as the projections (or teeth) 15 of the mechanical drive pinions 14 have little effect on the efficiency of the hydraulic pumping, the number thereof can be increased and the mechanical drive performance of the shafts 8 and 9 improved, and the efficiency of the hydraulic pumping of the gear wheel 20 can be improved by minimizing the number of projections (which could not be envisaged with a conventional pinion serving both the hydraulic pumping and the mechanical drive, as this would be contrary to the general knowledge of a person skilled in the art according to which, when the number of teeth is increased, hydraulic pumping efficiency is lost).

Moreover, separating the elements providing the mechanical drive 14 from those providing the hydraulic drive of the fluid makes it possible to adjust the angle of inclination of the projecting elements 15 of one with respect to the projecting elements 21 of the other.

To this end, provision is made to set the position of the lobes 21 of the gear wheels 20 with respect to the position of the teeth 15 of the pinions 14 on each shaft.

To this end, tapped blind holes are arranged through the gear wheels 20 with lobes 21, in particular in the central portion 23 of each of the lobed gear wheels 20, in a direction parallel to the axis of the gear wheel 20. In addition, each of the mechanical drive pinions 14 has openings 31 passing through it, the openings 31 being arranged in a direction parallel to the axis of the pinions 14 and through the central disk 16 (FIG. 2).

Preferably, provision is made for three through holes 31 in the central disk 16 of the mechanical drive pinions 14 and three tapped bind holes in the gear wheels 20 with lobes 21. The three through holes 31 as well as the three blind holes are made at equal distances from one another about the axis of the pinion 14 or of the gear wheel 20, respectively. The angle between two blind holes or two through holes is thus substantially 120°.

Fastening is carried out by screwing through the opening 31 into the blind hole of each gear wheel 20 with lobes 21.

Provision can also be made for means for angular adjustment of the position of the lobes 21 with respect to the position of the teeth 15 about the axis D8 or D9 of the shafts 8 and 9, and more particularly of the position of the hydraulic pumping element 20 with respect to the position of the mechanical drive pinion 14 about the axes D8 and D9 of the shafts 8 or 9.

These angular adjustment means are shown at least partially in FIG. 5.

These adjustment means comprise blind holes arranged in the gear wheels 20 (mentioned above), screws 30 (shown in FIG. 8 for example) and through holes 32 with the specific profile 32, arranged through the mechanical drive pinion 14, which will now be described with reference to FIG. 5.

Three openings 32 pass through the disk 16 in a direction parallel to the axis of the mechanical gear pinion 14.

The three through holes 32 are arranged at equal distances from one another, about the axis of the mechanical gear pinion 14.

Each of the three openings 32 are kidney-shaped, extending in an arc of circle about the axis of the mechanical drive pinion 14, thus having an oblong shape.

This incurved oblong shape of the openings 32 allows rotation of the mechanical drive pinion 14 about the shaft 8 or 9 with respect to the lobed gear wheel 20, after partial screwing of the screws into the blind holes in the gear wheels 20, so that it is possible to vary the position of a tooth 15 with respect to the position of a lobe 21 by varying the position of the screw in the opening 32 from one end 33 of the opening to the other end 34.

Thus, depending on the length of the arc of circle (between the ends 33 and 34 of the opening 32) following which the through hole 32 extends, the adjustment angle is larger or smaller.

As the gear wheel pinions 14 and the lobed gear wheels 20 do not have the same diameter, when one or more teeth 15 are placed between two lobes 21 (FIG. 3 for example), the teeth 15 and a portion of the disk 16 form a wall 28, at least partially closing a space 29 laterally between two lobes 21.

This wall 28 acts as a deflector on the fluid that is pumped in the pumping chamber 2, channelling the fluid between two lobes 21 to each side of the wall 28, during the rotation of the gear wheels 20 with lobes 21. By creating screen walls between the gear wheels 20, it is possible to position the gear wheels 20 with an angular offset to one another, avoiding the passage of fluid from one to the other. This offset leads to better performance by increasing the frequency of the pumping pulses. For example, in the case of a gear wheel 20 with six lobes 21, shown in FIGS. 1 to 4, the normal pulsation rate is 6. With a suitable angular position of the teeth 15 of the mechanical gear pinion 14 with respect to the lobes 21 of the gear wheel 20, it is possible to obtain a frequency of 12.

There is yet another advantage to separating the elements serving the hydraulic pumping (20) and those serving the mechanical drive (14): the shape of the lobes 21 of the lobed gear wheel 20 can be any whatever, since it is not also required to serve the mechanical drive of the shafts 8 and 9 on which they are mounted.

Figure 3:
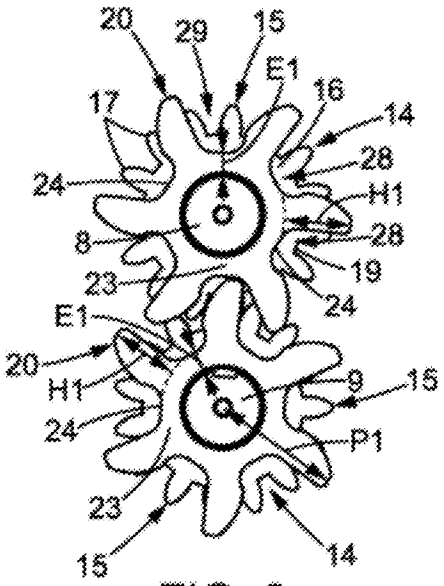
FIG. 3 is a front view of two shafts of the pump shown in FIG. 1, on which two mechanical drive pinions and two hydraulic pumping elements are mounted.

In fact, as can be seen in FIG. 2 or 3, the lobes 21 of a gear wheel 20 positioned on a shaft (8) do not bear on the lobes 21 of a second gear wheel 20 positioned on the other shaft (9). The shape of the lobes can thus more easily be adapted to the consistency of the fluid to be pumped.

Accordingly, in the embodiments shown in the figures, several shapes of projections will be noted, corresponding to embodiments suitable for different fluids.

The embodiment shown in FIGS. 1 to 4 shows gear wheels 20 with lobes 21, the lobes 21 of which have asymmetrical profiles (unlike the teeth 15 of the mechanical drive pinions 14).

In FIG. 4, it is noted that the lobes 21 each have a tip section 25, a substantially convex front part 26 and a substantially flat rear part 27. This is a conventional shape for lobes 21, the front part of which is usually used for rotational drive of the lobed gear wheel placed on the other shaft (this is not the case here).

The invention thus makes it possible to utilize conventional gear wheels 20 with lobes 21, in the pumping chamber 2 of the pump according to the invention, which is economical.

But as indicated above, the hydraulic pumping elements may have still different shapes without exceeding the scope of the invention.

Figure 6:
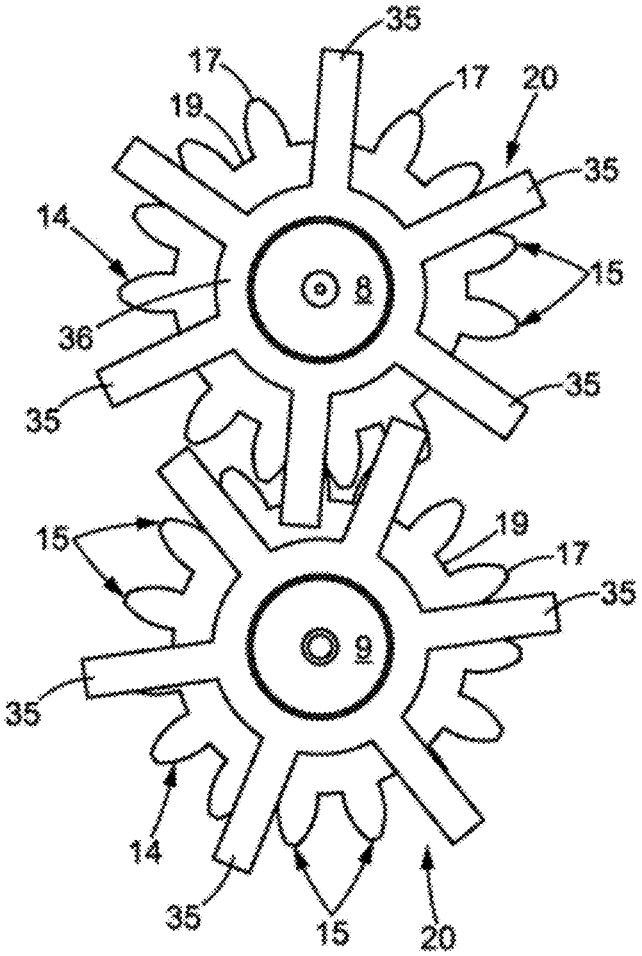
FIG. 6 is a front view of internal elements of a pump according to the invention, according to a variant, this view illustrating two mechanical drive pinions and two hydraulic pumping elements different from those illustrated in FIGS. 1 to 4.

For example, FIG. 6 shows the two shafts 8 and 9 on which two mechanical drive pinions 14 and two gear wheels 20 with blades 35 are mounted.

The blades 35 have a rectangular cross section and shape and they are positioned radially, evenly about a cylinder 36.

An advantage of such gear wheels 20 with blades 35 is that they are inexpensive to produce.

Figure 7:
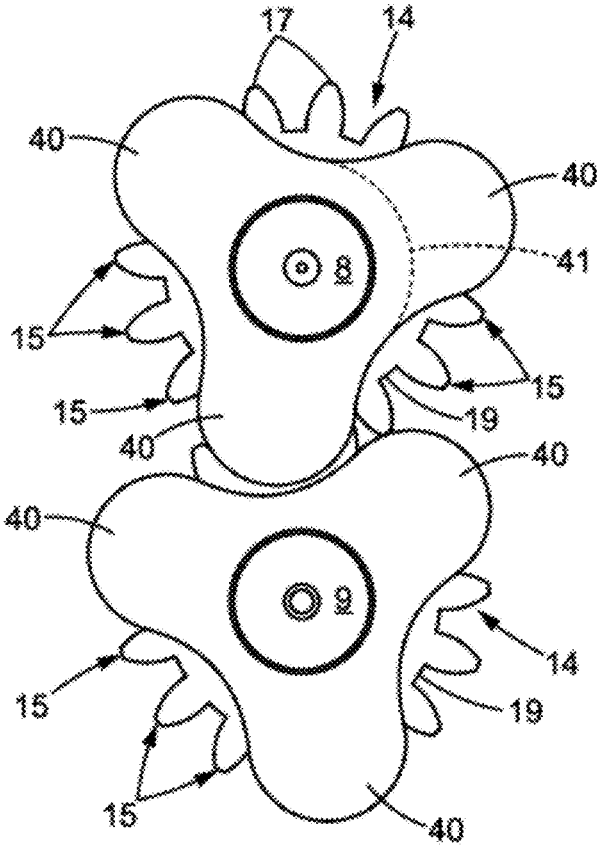
FIG. 7 is a further front view of two mechanical drive pinions and two hydraulic pumping elements different from those illustrated in FIG. 6.

Yet a further embodiment is shown in FIG. 7: in this example, the two mechanical drive pinions 14 are each fixed to a three-lobed gear wheel 40, on each of the shafts 8 and 9.

The three lobes 40 of the gear wheels 20 are identical and evenly distributed about the axis of each of the gear wheels 20. The lobes 40 each have a broad base 41 which extends substantially over one third of the periphery of the gear wheel 20.

Such an embodiment provides better hydraulic pumping of the fluid in the pumping chamber 2. In addition, the fluid is sheared less in the pumping chamber, so that such lobed gear wheels can be utilized in a pump for pumping a fluid that does not readily withstand mixing if it is desired to maintain its consistency.

Figure 8:
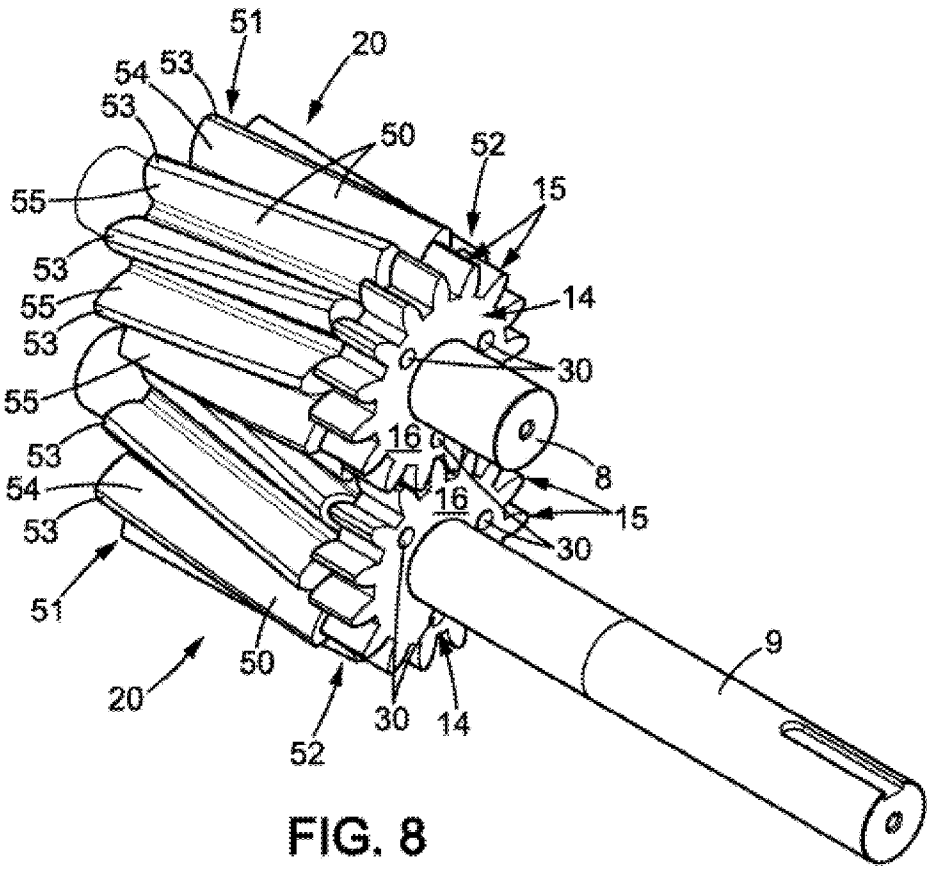
FIG. 8 is a perspective view of internal elements of a pump according to the invention, according to yet another variant.

FIG. 8 shows yet another embodiment, utilizing hydraulic pumping elements constituted by gear wheels 20 having a cylindrical shape, on each of which teeth 50 extend in a helical movement: each tooth extends from a first end 51 of the cylinder of the gear wheel 20 to a second end 52 at a helix angle.

The teeth 50 are bigger than the teeth 15 of the mechanical gear pinions 14. The teeth 50 have a tip 53, on each side of which two symmetrical convex lateral portions 54 and 55 extend. Each of the gear wheels 20 comprises fifteen teeth 50.

This embodiment has a definite advantage if it is desired to prevent pulsation in the pumping chamber 2.

This embodiment allows any helix angle whatever without requiring a minimum length in order to produce the hydraulic pumping element.

It should be noted that this is not the case in the usual gear pumps utilizing such pumping elements when they are also used for the mechanical drive: in fact, a contact ratio less than 1 must be complied with, which requires a minimum length in order to produce the pumping element.

It is understood from the foregoing that the invention is not limited to the utilization of a particular hydraulic pumping element, and that a volumetric pump could comprise yet further hydraulic pumping elements without exceeding the scope of the invention: for example, the hydraulic pumping elements could consist of worms positioned at the ends of the shafts 8 and 9 without exceeding the scope of the invention.

The invention also extends to pumps capable of comprising several stages of gear pinions 14 and/or hydraulic pumping elements 20.

Figure 9:
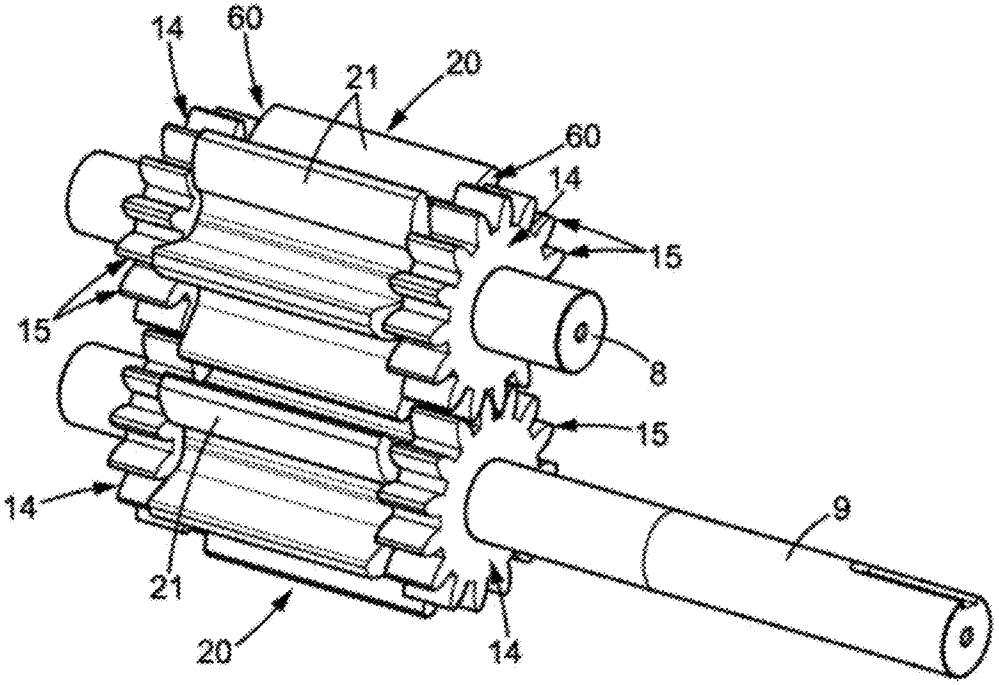
FIG. 9 is a perspective view of internal elements of a pump according to the invention, according to yet another variant.
Figure 10:
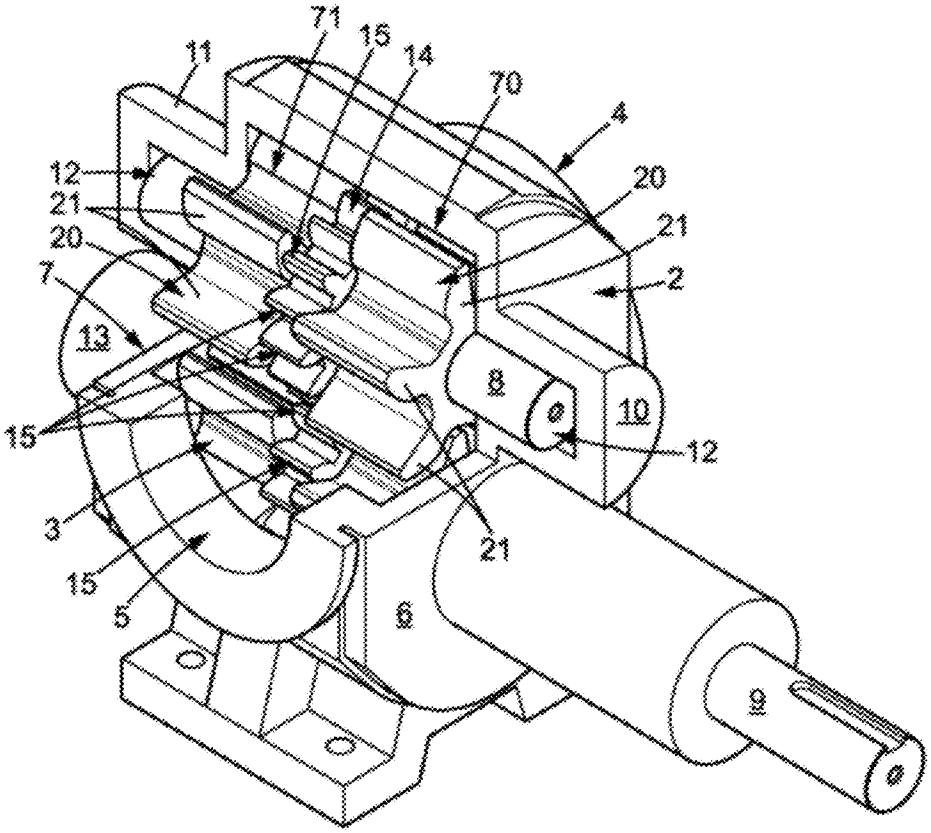
FIG. 10 is a perspective view of a gear pump according to the invention, showing a pumping chamber that is partially open in order to show the elements that it encloses, the pump being different from that illustrated in FIG. 1 in particular.

Two examples of different embodiments are shown in FIGS. 9 and 10.

In FIG. 9, two shafts 8 and 9 are shown (the same as those of the pumps described above), on each of which a wheel 20 with lobes 21 is mounted, as shown in FIGS. 1 to 4, on each side of which two mechanical drive pinions 14 are mounted.

The two mechanical drive pinions 14 are each fixed on an end face 60 of the gear wheel 20 with lobes 21, in the same way as that described previously in the context of the mounting of the mechanical drive pinion 14 on the gear wheel 20 with lobes 21 in FIGS. 1 to 4. In this case, each of the end faces 60 is equipped with three blind holes into which a screw 30 can be screwed.

The embodiment shown in FIG. 9 is beneficial within the context of the utilization of a volumetric pump that has a particularly long chamber: the presence of two mechanical drive pinions 14 at the two ends of the pumping chamber 2 allows the rotational drive of the shafts 8 and 9 about their respective axes to be balanced. This also allows a good distribution of the fluid in the pumping chamber 2.

FIG. 10 shows yet another embodiment: the pumping chamber 2 encloses two gear wheels 20 with lobes 21, between which a mechanical drive pinion 14 is positioned.

The gear wheels 20 can be angularly indexed in relation to one another by means of fitting onto a splined shaft.

This embodiment is beneficial due to the fact that the mechanical drive is positioned in the centre of the chamber: by angular adjustment of the position of the lobes 21 with respect to the position of the teeth 15 of the pinion 14, two hydraulic pumping stages 70 and 71 are created, which increases the performance of the pump, as previously explained. In fact, in this configuration, the mechanical drive pinion 14 also acts as a screen between the two gear wheels 20 with lobes 21, which makes it possible to limit the leakage of fluid in the pumping chamber from one stage 70 of gear wheels with lobes 21 to the other 71.

It is understood from the foregoing how the invention makes it possible to produce pumps with better performance that those hitherto known.

It should however be understood that the invention is not limited to the embodiments that have been described and that it can be extended to further embodiments.

In particular, all the examples illustrated in the figures show hydraulic pumping elements 20 that are made independently of the mechanical drive pinions 14. However, the invention also relates to embodiments according to which a hydraulic pumping element and a mechanical drive pinion are made in a single piece: in this case, the piece produced separately comprises two parts having different forms, one constituting the hydraulic pumping element and the other constituting the mechanical drive pinion.

The invention claimed is:

1. A gear pump comprising:

a pumping chamber in which a first shaft and a second shaft are driven in rotation about the respective axis thereof, each of the first and second shafts bearing at least one hydraulic pumping element providing the hydraulic pumping of a fluid in the pumping chamber, said at least one hydraulic pumping element of each of said first and second shafts being positioned in said pumping chamber and each having at least one first radial projection, in the pumping chamber, each of said first and second shafts bearing at least one mechanical drive pinion configured to mechanically drive in rotation each of said first and second shafts, each mechanical drive pinion having second radial projections; and an angular adjustment means for angular adjusting of the position of the at least one hydraulic pumping element with respect to the at least one mechanical drive pinion about the respective axis of the first and second shafts, wherein, on each of said first and second shafts, said at least one mechanical drive pinion is distinct from said at least one hydraulic pumping element, wherein said at least one first radial projection and said second radial projections differ in number, and an assembly formed by said at least one mechanical drive pinion and said at least one hydraulic pumping element of said first and second shafts constitutes the gearing of the pump.

2. The gear pump according to claim 1, wherein said at least one hydraulic pumping element of each shaft is made from at least one gear wheel with lobes, the lobes constituting first projections for the hydraulic pumping element.

3. The gear pump according to claim 2, wherein said at least one first projection has a first radial height, wherein the second projections have a second radial height, and wherein said first radial height is greater than said second radial height.

4. The gear pump according to claim 2, wherein each of the first and second shafts bears a mechanical drive pinion positioned between two hydraulic pumping elements.

5. The gear pump according to claim 2, wherein each of the first and second shafts bears a hydraulic pumping element positioned between two mechanical drive pinions.

6. The gear pump according to claim 2, wherein each of the first and second shafts bears a hydraulic pumping element and a mechanical drive pinion.

7. The gear pump according to claim 2, wherein said at least one hydraulic pumping element and said at least one mechanical drive pinion of each shaft are made in a single piece.

8. The gear pump according to claim 1, wherein said at least one first projection has a first radial height, wherein the second projections have a second radial height, and wherein said first radial height is greater than said second radial height.

9. The gear pump according to claim 8, wherein each of the first and second shafts bears a mechanical drive pinion positioned between two hydraulic pumping elements.

10. The gear pump according to claim 8, wherein each of the first and second shafts bears a hydraulic pumping element positioned between two mechanical drive pinions.

11. The gear pump according to claim 8, wherein each of the first and second shafts bears a hydraulic pumping element and a mechanical drive pinion.

12. The gear pump according to claim 8, wherein said at least one hydraulic pumping element and said at least one mechanical drive pinion of each shaft are made in a single piece.

13. The gear pump according to claim 1, wherein each of the first and second shafts bears a mechanical drive pinion positioned between two hydraulic pumping elements.

14. The gear pump according to claim 13, wherein said at least one hydraulic pumping element and said at least one mechanical drive pinion of each shaft are made in a single piece.

15. The gear pump according to claim 1, wherein each of the first and second shafts bears a hydraulic pumping element positioned between two mechanical drive pinions.

16. The gear ar pump according to claim 1, wherein each of the first and second shafts bears a hydraulic pumping element and a mechanical drive pinion.

17. The gear pump according to claim 1, wherein said at least one hydraulic pumping element and said at least one mechanical drive pinion of each shaft are made in a single piece.

18. The gear pump according to claim 1, wherein, on each of the first and second shafts, said at least one mechanical drive pinion is fixed to said at least one hydraulic pumping element.

19. The gear pump according to claim 1, wherein, for each of said first and second shafts, said at least one hydraulic pumping element and said at least one mechanical drive pinion are made from different materials.

* * * * *